US006904951B2

(12) United States Patent
Murayama et al.

(10) Patent No.: US 6,904,951 B2
(45) Date of Patent: Jun. 14, 2005

(54) CASTING DEVICE FOR METAL PRODUCTS

(75) Inventors: Tomiyuki Murayama, Toyota (JP); Ken Torii, Toyota (JP); Yukinao Demachi, Toyota (JP)

(73) Assignee: Aisin Takaoka, Co., Ltd., Toyota (JP)

( * ) Notice: Subject to any disclaimer, the term of this patent is extended or adjusted under 35 U.S.C. 154(b) by 11 days.

(21) Appl. No.: 10/364,492

(22) Filed: Feb. 11, 2003

(65) Prior Publication Data

US 2003/0155095 A1 Aug. 21, 2003

(30) Foreign Application Priority Data

Feb. 18, 2002 (JP) ..... 2002-039559

(51) Int. Cl.[7] ..... B22D 17/12; B22D 23/00; B22D 25/00

(52) U.S. Cl. ..... 164/312; 164/113; 164/314

(58) Field of Search ..... 164/113, 312, 164/314

(56) References Cited

U.S. PATENT DOCUMENTS 5,730,201 A * 3/1998 Rollin et al. ..... 164/113

2003/0024682 A1 * 2/2003 Tsuchiya et al. ..... 164/312

* cited by examiner

*Primary Examiner*—Kuang Y. Lin

(74) *Attorney, Agent, or Firm*—Welsh & Katz, Ltd.

(57) ABSTRACT

A casting device for metallic product includes a main unit 1 having a pressurizing chamber 14 and casting cavities 16 for accommodating a metallic material M, a pressurizing unit 3 for pressurizing the metallic material M contained in the pressurizing chamber 14 to cause the metallic material to flow into the casting cavities 16 and a blade unit 4 provided between the pressurizing chamber 14 and the casting cavities 16. The blade unit 4 includes a scraper edge 41 for scraping the outer layer of the metallic material M pressurized by the pressurizing unit 3. After the end of the scraping operation for the outer layer M2 of the metallic material M, the blade unit 4 is moved by the first driving unit 51 from the scraping position A1 to a disengaging position. Thereby, the metallic material can be readily separated from the blade unit.

10 Claims, 6 Drawing Sheets

CASTING DEVICE FOR METAL PRODUCTS

FIELD OF THE INVENTION

This invention relates to a casting device for a high quality cast metal product.

BACKGROUND OF THE INVENTION

Recently, there is a general demand for cast products of higher quality. In this perspective, there is provided in JP Patent Kokai JP-A-7-256422 a casting device for a metal product. This casting device includes a metal die unit, having a pressurizing chamber for holding a metal material of, for example, an aluminum alloy in the solid-liquid co-existing state, and a casting cavity into which the metal material flows to form a cast product, a pressurizing cylinder for pressurizing the metal material held in the pressurizing chamber of the metal die unit to cause the pressurized material to flow into the casting cavity to produce a cast product, and a stripping blade abutting against the outer layer of the metal material and pressurized by a pressurizing plunger, to strip off the outer layer.

The outer layer of the metal material is exposed to air and hence is liable to be contaminated by impurities such as oxides. Additionally, the outer layer of the metal material is quenched by the inner wall surface of a chamber for molten metal material and hence is likely to be of a transmuted texture. Moreover, if a die coating agent for lubrication or thermal resistance is applied to the inner wall surface of the pressurizing chamber, the die coating agent tends to become affixed to the outer layer of the metal material. Impurities, transmuted structure or the die coating agent, if allowed to flow into the casting cavity, are deleterious to the quality of the cast product. Thus, with the above-identified casting device for a metal product, when the metal material is pressurized by the pressurizing cylinder so as to flow into the casting cavity, the outer layer of the metal material is scraped with a scraping edge, such as a blade. This prohibits the impurities, transmuted structure or the die coating agent from being entrained into the cast product to achieve an improved quality of the cast product.

Meanwhile, there is much to be desired in the art for further improvement. In the above-described casting device for a metal product, the scraper edge of the blade unit nips into the metal material. The result is that, when the operation of scraping off the outer layer of the metal material has come to a close, it is not so easy to separate the blade unit from the metal material.

Thus, in the above-identified publication, a second blade unit is provided on the pressurizing plunger, in addition to the blade unit provided within the metal die unit. When the scraping operation for the outer layer of the metal material comes to a close, the metal material is punched and severed under the shearing force generated by the blade unit within the metal die unit and the second blade unit of the pressuring plunger, thereby completely separating the metal material and the blade unit. In such case, the second blade unit must be provided to the pressurizing plunger, thus possibly raising the equipment cost.

In view of the above-depicted states of the art, there is much to be desired in the art for further improvement.

PREFERRED EMBODIMENTS OF THE INVENTION

Figure 1:
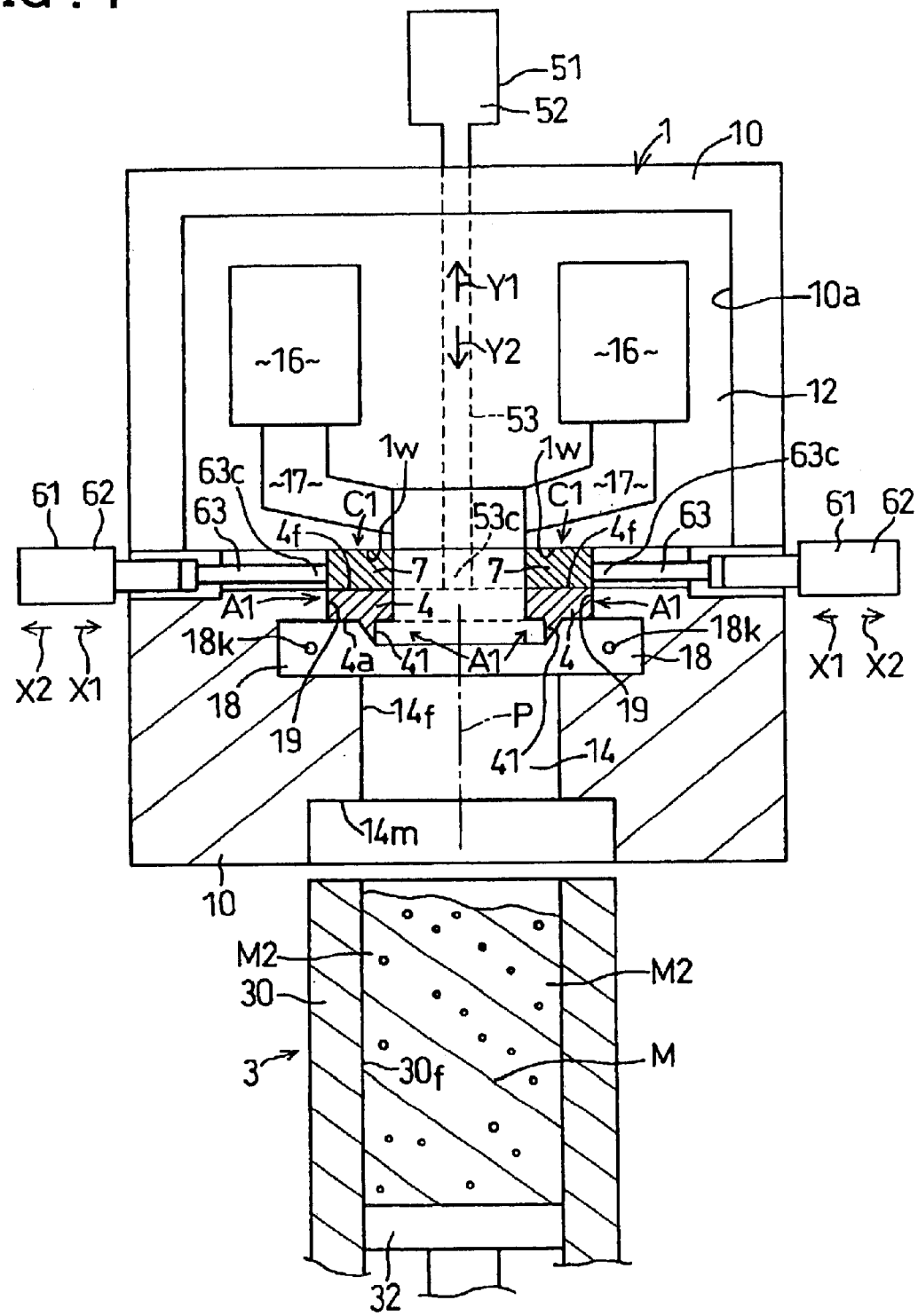
FIG. 1 is a cross-sectional view schematically showing a casting device for a metallic product and specifically showing the state prior to setting a fitting tube on a seat of a pressurizing chamber.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, not should be inferred to the limit of the subject matter disclosed herein.

All patents referred to herein, are hereby incorporated herein by reference, whether or not specifically to do so within the text of this disclosure.

In the present disclosure, the words "a" or "an" are to be taken to include both the singular and the plural. Conversely, any reference to plural items shall, where appropriate, include the singular.

Thus, it is an object of the present invention to provide a casting device for a metal product of the type in which the blade unit for scraping the outer layer of the metallic material is freed from the disadvantage as aforementioned.

Specifically, it is an object of the present invention to provide a casting device for a metal product in which, on completion of the operation of scraping of the outer layer of the metal material, facilitated separation of the metal material and the blade unit from each other is assured.

According to a first aspect of the present invention, there is provided a casting device which comprises a main unit including a pressurizing chamber for accommodating a metallic material in a solid/liquid co-existing state or in a liquid phase state and a casting cavity into which the metallic material is caused to flow to form a cast product, a pressurizing unit for pressuring the metallic material contained in the pressurizing chamber of the main unit for forcing the metallic material into the casting cavity to produce a cast product, and a blade unit including a scraper edge provided between the pressurizing chamber and the casting cavity. The scraper edge is adapted for abutting against an outer layer of the metallic material, being pressurized by the pressurizing unit, for scraping the outer layer. The blade unit is set for being changed over between a scraping position in which the scraper edge of the blade unit is abutted against the metallic material to scrape an outer layer thereof and a disengagement position in which the scraper edge of the blade unit is disengaged from the metallic material. The casting device also includes a first driving unit for moving the blade unit from the scraping position to the disengagement position.

With the casting device for a metallic product according to the present invention, the pressuring unit pressurizes the metallic material in the pressurizing chamber, as the blade unit is at the scraping position. The metallic material in the pressurizing chamber then is forced into the casting cavity to form a cast product. When (during) the metallic material in the pressurizing chamber is forced in this manner into the casting cavity, an outer layer of the metallic material is (simultaneously) scraped by the scraper edge of the blade unit. This prevents impurities, die coating materials or transmuted structures, produced on or affixed to the outer layer of the metallic material, from being entrained into the casting cavity along with the metallic product.

With the casting device for a metallic product according to the present invention, when the operation of scraping the outer layer of the metallic material is completed, the blade unit at the scraping position is moved by the first driving unit to the disengagement position. This enables the scraper edge, so far engaged with the metallic material, to be disengaged from the metallic material. By separating the scraper edge of the blade unit from the metallic material, the metallic material can readily be released from the pressurizing chamber of the main unit. In a preferred embodiment, the movement to the disengagement position is carried out by an axial movement of the scraping edge. However the disengagement movement may be suitably designed depending on the shape and dimension of the cast products.

The metal material used in the present invention is in the solid-liquid co-existing state or in the liquid phase state, and may be exemplified by aluminum alloys, magnesium alloys and zinc alloys. The solid-liquid co-existing state means a state where a solid phase and a liquid phase exist together. The metal material in the solid-liquid co-existing state may be exemplified by such a metal material in which the amount of the solid phase is 20 to 80 wt % and in particular 30 to 70 wt %, with the amount of the liquid phase being 80 to 20 wt % and in particular 70 to 30 wt %, respectively. This composition is merely illustrative and is not intended for limiting the invention. If the metal material is in the liquid phase, and the metal material in such liquid phase is placed in the pressuring chamber, the metal material in the liquid phase state is cooled in contact with the inner wall surface of the pressurizing chamber, such that the outer layer is progressively converted into the solid phase. Thus, the impurities, transmuted structure or the die coating agent, contained in the outer layer, may be removed by scraping the outer layer of the metal material by an edge of a scraping blade.

The blade unit is abutted against the outer layer of the metal material, pressurized by the pressuring unit, for scraping the outer layer. The blade unit is preferably of the type exchangeable with respect to a main unit. In this case, since the blade unit, if injured, may be exchanged, thus assuring optimum stripping of the outer layer of the metal material. Such stripping of the outer layer of the metal material is usually carried out such as to scrape a (entire) round of the outer layer of the metal material. Alternatively, only a portion or portions of the outer layer of the metal material where impurities or transmuted structures tend to be formed or where the die coating agent tend to be deposited may be locally scraped off.

The blade unit is movable between the scraping position of scraping off the outer layer of the metal material, with the blade unit hereat abutting against the metal material, and the non-scraping disengagement position, where the scraper edge of the blade unit is disengaged from the metal material. Consequently, a first driving unit is provided for moving the blade unit from the scraping position to the non-scraping disengagement position. The first driving unit may be exemplified by a fluid pressure cylinder device and a motor device. The fluid pressure cylinder device may be exemplified by a hydraulic cylinder device or a pneumatic cylinder device.

In a preferred embodiment, a backup unit may be provided which, when the blade unit is at the scraping position, is located on the back surface side of the scraper edge of the blade unit. By arranging the backup unit on the back surface side of the scraper blade of the blade unit, the blade unit can be backed up to improve the holding performance of the blade unit. That is, when the outer layer of the metal material is scraped off by the scraper blade of the blade unit, the blade unit can be prevented from being inadvertently shifted to assure an optimum highly reliable outer layer scraping operation.

Preferably, the backup unit is provided for movement between the backup position in which the backup unit is located on the back surface side of the scraper blade of the blade unit for backing up the blade unit and a receded position in which the backup unit is receded away from the back surface of the blade unit. Thus, a second driving unit is preferably provided for moving the backup unit between the backup unit and the receded position. The second driving unit may be exemplified by a fluid pressure cylinder device or a motor device. The fluid pressure cylinder device may be exemplified by a hydraulic cylinder device or a pneumatic cylinder device.

The backup unit may be provided with cooling means for cooling the blade unit through the backup unit. Since the backup unit may be cooled by the cooling means, the blade unit may be improved in its cooling performance, through the backup unit, thus preventing thermal defect or deterioration of the blade unit.

The main unit preferably includes a chip (or debris) accommodating chamber for accommodating scraping chips of the outer layer of the metal material. The chip accommodating chamber is preferably disposed just below or downward of the blade unit. In this case, the scraping chips produced on scraping the outer layer of the metal material may promptly be accommodated in the chip accommodating chamber.

Referring to FIGS. 1 to 5, a preferred embodiment of the present invention is explained in detail. In FIG. 1, a casting device for metallic products of the present embodiment includes a main unit (base body) 1, a pressurizing unit 3 and a blade unit 4. The main unit 1 is made up by an outer frame metal die 10 of a metallic material and a casting die 12 kept in a nested fashion in a recess (interior space) 10*a* of the outer frame metal die 10. The outer frame metal die 10 includes a cylindrically-shaped pressurizing chamber 14 for accommodating a solid/liquid metallic material M in which co-exist the solid phase and the liquid phase. A heat-resistant or lubricating die coating agent is routinely applied to an inner wall surface 14*f* of the pressurizing chamber 14. The casting die 12 includes plural casting cavities 16 into which the metallic material M is charged to form a cast product, and plural gate cavities 17 communicating with the bottom portions of the respective casting cavities 16. The casting cavities 16 are of the bottom charging type in which the metallic material M flows from the bottom side of the casting cavities 16. The main unit 1 includes a chip accommodating chamber 18 for accommodating scraping chips (or debris) M3 (see FIG. 4) produced on scraping the outer layer of the metal material M, and a guide surface 19 for guiding the blade unit 4. The chip accommodating chamber 18 is provided below the blade unit 4 for communication with the pressurizing chamber 14 and is provided in an annular (or ring) pattern around the pressurizing chamber 14. The chip accommodating chamber 18 is provided with an ejector pin 18*k* for ejecting the scraping chips M3. By protruding the ejector pin 18*k* towards the chip accommodating chamber 18, the scraping chips M3 within the chip accommodating chamber 18 can be discharged at a higher efficiency, so that the ejector pin 18*k* can be operated as a chip removal promoting means.

The pressurizing unit 3 pressurizes the metal material M, accommodated in the pressurizing chamber 14 of the main unit 1, and includes a fitting tube 30, detachably seated on a seat 14*m* of the pressurizing chamber 14, and a pressurizing plunger 32 slidably mounted within the fitting tube 30.

Figure 2:
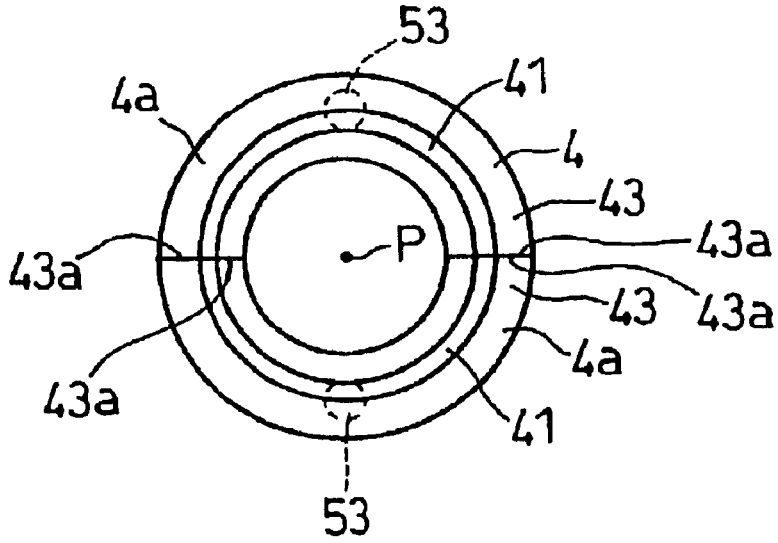
FIG. 2 is a bottom plan view of the blade unit.

The blade unit 4 is provided between the pressurizing chamber 14 and the casting cavities 16 of the main unit 1. A scraper edge 41 is provided to the lower surface 4*a* of the blade unit 4. The scraper edge 41 is abutted against the outer layer M2 of the metallic material M, pressurized by the pressurizing plunger 32 of the pressurizing unit 3, for scraping off an outer layer M2 of the metallic material M. Referring to FIG. 2, the blade unit 4 is in an overall ring shape, such as to take a round about a centerline P of the pressurizing chamber 14, and is made up by a pair of half-split portions 43, each in the form of a half-ring shape, having a splitting surface 43*a*. The scraper edge 41 is formed as a ring so as to take a round about the centerline P of the pressurizing chamber 14. The blade unit 4 is a separate unit from the main unit 1 and exchangeable. That is, if the blade unit 4 suffers any defect, it may be exchanged with a new one. The blade unit 4 is formed of metals, such as heat-resistant steel, or heat-resistant ceramics.

Referring to FIG. 1, the casting device for metallic articles of the present embodiment includes a first fluid pressure cylinder device 51, as a first driving unit. The first fluid pressure cylinder device 51 includes a first cylinder main body unit 52, secured to a stationary portion, not shown, and a first cylinder rod 53, as an operator therefor, provided to the first cylinder main body unit 52 for performing fore-and-aft movement along the vertical direction indicated by arrows Y1 and Y2. To a distal end 53*c* of the first cylinder rod 53, the half-split portion 43 of the blade unit 4 is connected by a connecting tool, not shown. Since via a pair of the splitting surfaces 43*a* make up the blade unit 4, there are provided two of the first fluid pressure cylinder devices 51. When each first fluid pressure cylinder device 51 is in operation such that the first cylinder rod 53 is moved in a direction away from the pressurizing chamber 14, as indicated by arrow Y1, the blade unit 4 may be elevated along the guide surface 19 so as to be moved from a lower scraping position A1 (see FIG. 1) to an upper non-scraping disengagement position A2 (see FIG. 5). When the first fluid pressure cylinder device 51 is driven in reverse such that the first cylinder rod 53 is moved in a direction approaching to the pressurizing chamber 14 as indicated by arrow Y2, the blade unit 4 can be moved along the guide surface 19 so as to be moved from the upper non-scraping disengagement position A2 (see FIG. 5) towards the lower scraping position A1 (see FIG. 1). Stated differently, the blade unit 4 is set so as to be changed over between the scraping position A1 at which the scraper edge 41 of the blade unit 4 is abutted against the metallic material M to scrape off the outer layer of the metallic material M (see FIG. 1) and the non-scraping disengagement position A2 at which the scraper edge 41 of the blade unit 4 is disengaged from the metallic material M (see FIG. 5).

Referring to FIG. 1, the casting device for a metallic article according to the present embodiment includes a metallic back-up unit 7, as shown in FIG. 1. When the blade unit 4 is at the scraping position A1, the back-up unit 7 is located on a back surface 4*f* of the scraper edge 41 of the blade unit 4 to back up the blade unit 4. The back-up unit 7 can be changed over between a back-up position C1 at which the back-up unit is located on the back surface 4*f* of the scraper edge 41 of the blade unit 4 to back up the blade unit 4 (see FIG. 1) and a receded position C2 in which the back-up unit is moved along the horizontal direction (i.e., transverse to the direction of movement Y1 and Y2) and thus receded from the back surface 4*f* of the blade unit 4 (see FIG. 4). Generally, the scraper edge is disposed transverse (typically, at right angles) to the flow direction of the metallic material.

The casting device for the metallic product of the present embodiment further includes a second fluid pressure cylinder device 61, as a second driving unit. The second fluid pressure cylinder device 61 includes a main body unit of the second cylinder device 62, secured to a stationary portion, not shown, and a second cylinder rod 63, as an operator, provided to the second cylinder main body unit 62 for performing fore-and-aft movement along the horizontal direction indicated by arrows X1 and X2. To a distal end 63*c* of the second cylinder rod 63 is connected the back-up unit (member) 7. When the second cylinder rod 63 of the second fluid pressure cylinder device 61 is moved inwards for approaching to the blade unit 4, as indicated by arrow X1, the back-up unit 7 may be moved to the back-up position C1 (see FIG. 1). When the second cylinder rod 63 of the second fluid pressure cylinder device 61 is moved outwards (i.e., radially) away from the blade unit 4, as indicated by arrow X2, the back-up unit 7 may be moved from the back-up position C1 to the receded position C2 (see FIG. 4). That is, the second fluid pressure cylinder device 61 is adapted for moving the back-up unit 7 between the back-up position C1 and the receded position C2.

In use of the metal die device, the first cylinder rod 53 of the first fluid pressure cylinder device 51 is driven downwards (in the direction indicated by arrow Y2) towards the pressurizing chamber 14, until the blade unit 4 is placed at the scraping position A1, as shown in FIG. 1. The second cylinder rod 63 of the second fluid pressure cylinder device 61 then is moved inwards (in the direction indicated by arrow X1) for approaching to the blade unit 4 for moving the back-up unit 7 to the back-up position C1 for placing the back-up unit 7 on the back surface 4*f* of the blade unit 4. The back-up unit 7, located at the back-up position C1, is constrained on a constraint surface 1*w* of the main unit 1 and is thereby prohibited from performing any further upwards movement.

In casting, a required amount of the metallic material M in the solid-liquid co-existing state is accommodated within a fitting tube 30. The outer layer M2 of the metallic material M, contained in the fitting tube 30, is cooled by the inner wall surface 30*f* of the fitting tube 30 such that the layer of the solidified crust is gradually increased in thickness. The metallic material M is, e.g., an aluminum alloy based material and maintained for example at 550 to 600° C.

Figure 3:
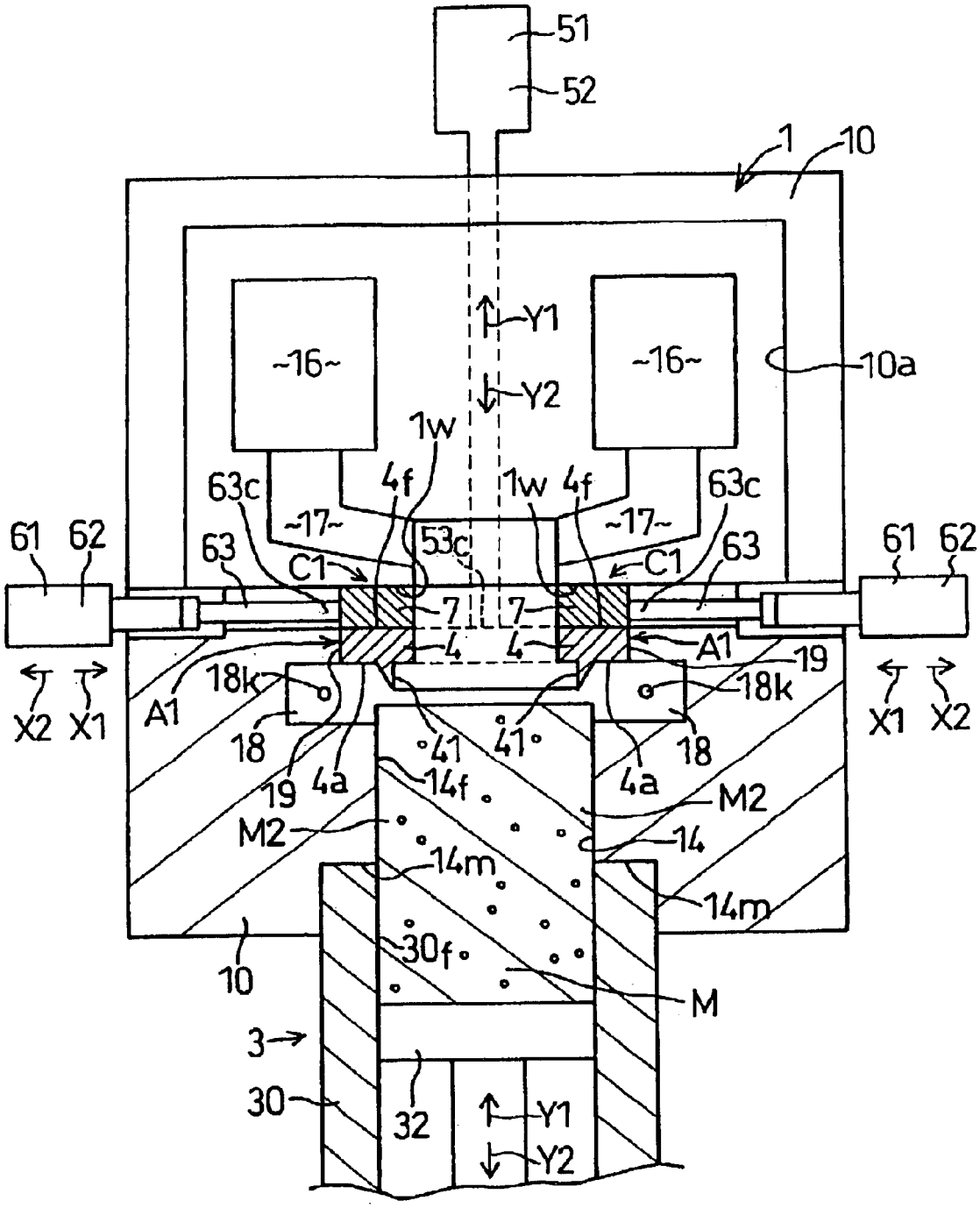
FIG. 3 is a cross-sectional view schematically showing a casting device for a metallic product and specifically showing the state in which the metallic material in the pressurizing chamber is being pressurized by a pressurizing plunger.

In this state, the fitting tube 30 is moved, as shown in FIG. 3, for setting the fitting tube 30 on a seat 14*m* of the pressurizing chamber 14, while the pressurizing plunger 32 is operated for pressurizing in an upward direction (in the direction indicated by arrow Y1) for accommodating the metallic material M in the pressurizing chamber 14. The outer layer M2 of the metallic material M, contained in the pressurizing chamber 14, is cooled by the inner wall surface 14*f* of the pressurizing chamber 14 such that the solidified layer is gradually increased in thickness. Meanwhile, it is a frequent occurrence that impurities such as oxides or die coating agents for the inner wall surface 14*f* of the pressurizing chamber 14 are contained in the solidified layer.

Upon charging the metallic material M into the casting cavities 16, the pressurizing plunger 32 is advanced in a direction of decreasing the capacity of the pressurizing chamber 14, that is, in a direction indicated by arrow Y1. This causes the metallic material M in the pressurizing chamber 14 to be moved towards the casting cavities 16 so as to flow into the casting cavities 16 through the gate cavities 17. In the present embodiment, the metallic material M is caused to flow into the casting cavities 16 upwards from below. The metallic material M is charged in this manner into the casting cavities 16.

As the metallic material M has been charged in the casting cavities 16, the pressurizing operation by the pressurizing plunger 32 is continued for a preset length of time. A cast product is obtained as solidification proceeds of the metallic material M that has flown into the casting cavities 16 progresses.

Figure 4:
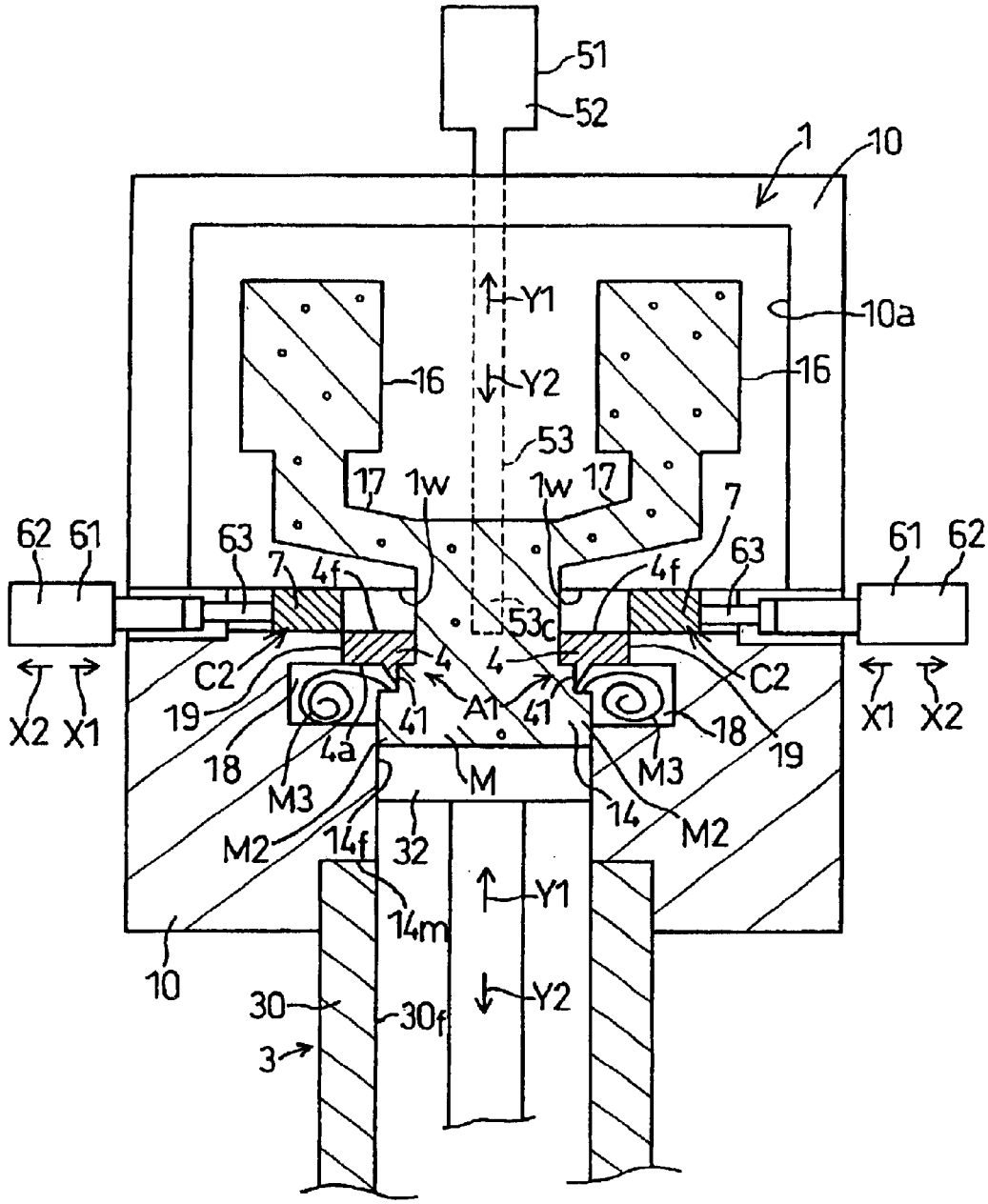
FIG. 4 is a cross-sectional view schematically showing a casting device for a metallic product and specifically showing the state in which the backup unit has been receded after charging the metallic material into the casting cavities.
Figure 5:
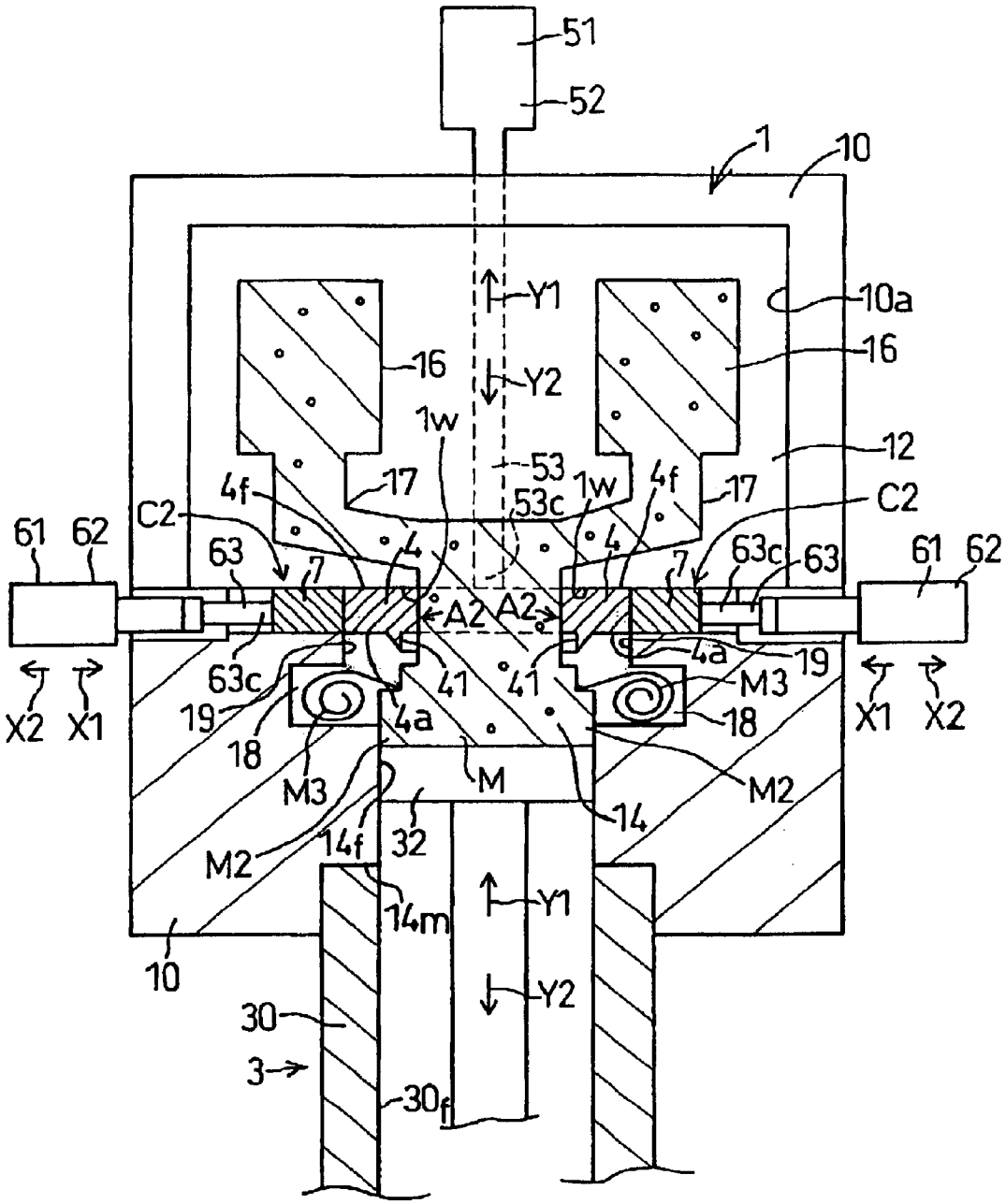
FIG. 5 is a cross-sectional view schematically showing a casting device for a metallic product and specifically showing the state in which the blade unit has been disengaged from the metallic material after receding the backup unit.

In the present embodiment, when the metallic material M in the pressurizing chamber 14 flows into the casting cavities 16, the outer layer M2 of the metallic material M is abutted against the scraper edge 41 of the blade unit 4 and is scraped by the scraper edge 41. The scraping chips M3 are driven to outside the scraper edge 41 of the blade unit 4 and forced into the inside of the chip accommodating chamber 18, as shown in FIG. 4. As a consequence, the impurities, transmuted texture portions or die coating agents, generated on or affixed to the outer layer M2 of the metallic material M, may be prevented from being entrained into the casting cavities 16, thus improving the quality of the cast product obtained in the casting cavities 16.

When the outer layer M2 of the metallic material M is scraped by the scraper edge 41 of the blade unit 4, a considerable amount of an external force is applied to the blade unit 4. In the present embodiment, when the outer layer M2 of the metallic material M is scraped by the scraper edge 41 of the blade unit 4, the back-up unit 7 is moved to the back-up position C1 and located on the back surface 4*f* of the blade unit 4 to back up the blade unit 4, as shown in FIG. 3, to enhance the retention performance of the blade unit 4. As a consequence, the blade unit 4 may be prevented from being inadvertently moved at the time of scraping, while the operation of scraping the outer layer M2 of the metallic material M may be performed accurately. It should be noted that, during scraping, the metallic material M nips (or bites) into the scraper edge 41 of the blade unit 4.

When the scraping operation, described above, has come to a close, the second cylinder rod 63 of the second fluid pressure cylinder device 61 is driven in the direction away from the blade unit 4, that is towards outside (in the direction indicated by arrow X2), as shown in FIG. 4. This disengages the back-up unit 7 from the back surface 4*f* of the blade unit 4 so as to be moved from the back-up position C1 towards the receded position C2. The first fluid pressure cylinder device 51 then is driven for driving the first cylinder rod 53 thereof in the direction away from the pressurizing chamber 14, that is towards above (in the direction indicated by arrow Y1). This causes the blade unit 4 to be moved in a direction away from the pressurizing chamber 14, that is upwards (in the direction indicated by arrow Y1) so as to be located at an upper non-scraping disengagement position A2. As a consequence, the scraper edge 41 of the blade unit 4, which has so far nipped into the metallic material M, may be disengaged from the metallic material M.

When the scraper edge 41 of the blade unit 4 is disengaged from the metallic material M, as described above, the state of nipping of the scraper edge 41 and the metallic material M is annulled, and hence the remaining portion of the metallic material M may readily be dismounted from the main unit 1.

By the above casting, a molded article comprised of the cast product formed in the casting cavities 16, unified to the gate formed in the gate cavities 17, is produced. Since the nipping of the scraper edge 41 with the metallic material M has been annulled, this molded product may readily be dismounted from the main unit 1. On completion of the casting operation, the scraping chips M3, forced into the chip accommodating chamber 18, is taken out from the chip accommodating chamber 18. If the ejector pin 18*k* is ejected towards the chip accommodating chamber 18, the scraping chips M3 can readily be taken out from the chip accommodating chamber 18. In case where the scraping chips M3 can readily be taken out from the chip accommodating chamber 18, the ejection pin 18*k* may be dispensed with. When the casting process has come to a close, the fitting tube 30 is dismounted from the pressurizing chamber 14, at the same time as the pressurizing plunger 32 is restored to its original position.

When the next casting operation is to be performed, the first cylinder rod 53 of the first fluid pressure cylinder device 51 is driven towards the pressurizing chamber 14, in the direction indicated by arrow Y2, until the blade unit 4 is arranged at the lower scraping position A1. The second cylinder rod 63 of the second fluid pressure cylinder device 61 is then driven towards the blade unit 4 in the direction indicated by arrow X1 to shift the back-up unit 7 to the back-up position C1 until the back-up unit 7 is placed on the back surface 4*f* of the scraper edge 41 of the blade unit 4. The fitting tube 30 is set on the seat 14*m* of the pressurizing chamber 14, while the metallic material M in the solid-liquid co-existing state is accommodated in the pressurizing chamber 14.

In the present embodiment, described above, when the scraping of the outer layer of the metallic material M has come to a close, the blade unit 4 at the scraping position A1 is moved by the first fluid pressure cylinder device 51 to the upper non-scraping disengagement position A2. In this manner, the scraper edge 41 of the blade unit 4 and the metallic material M, so far in the nipping relation with respect to each other, can readily be separated from each other. By disengaging the scraper edge 41 of the blade unit 4 from the metallic material M, which as so far been in the nipping relation to the scraper edge 41 of the blade unit, the metallic material M can readily be released from the pressurizing chamber 14 of the main unit 1.

When the outer layer M2 of the metallic material M is scraped by the scraper edge 41 of the blade unit 4, a significant external force is applied to the blade unit 4. In the present embodiment, when the outer layer M2 of the metallic material M is scraped by the scraper edge 41 of the blade unit 4, the back-up unit 7 is beforehand moved inwards to the back-up position C1 and located on the back surface 4*f* of the blade unit 4 to back up the blade unit 4, as shown in FIG. 3, to elevate the retention performance of the blade unit 4. As a consequence, the blade unit 4 may be prevented from being inadvertently moved at the time of scraping, while the operation of scraping the outer layer M2 of the metallic material M may be performed accurately. Moreover, if there is no necessity of backing up the blade unit 4, the second cylinder rod 63 of the second fluid pressure cylinder device 61 may be driven in a direction away from the blade unit 4, that is in the direction indicated by arrow X2, for moving the back-up unit 7 from the back-up position C1 towards the receded position C2. As a consequence, the back-up unit is not obstructive to the movement of the blade unit in the scraping position A1 towards the upper non-scraping disengagement position A2.

In addition, if, in the present embodiment, the back-up unit 7 is arranged at the back-up position C1, as shown in FIG. 3, the back-up unit 7 is contacted with the back surface 4*f* of the blade unit 4, so that the heat in the back-up unit 7 is transmitted to the blade unit 4. Consequently, the blade unit 4 contacted with the heated metallic material M may be cooled in an accelerated manner to suppress heat damage to the blade unit 4.

Figure 6:
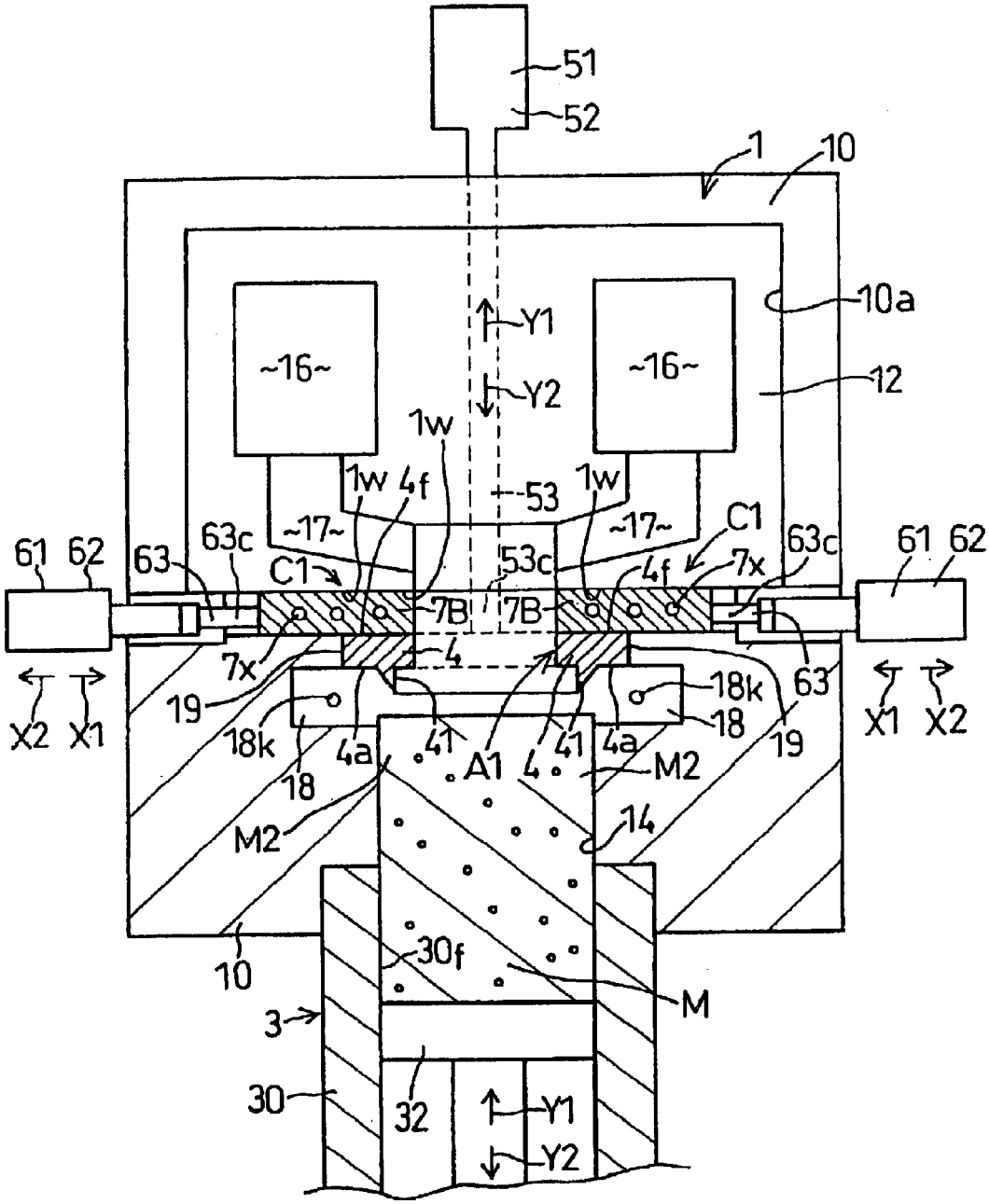
FIG. 6 is a cross-sectional view schematically showing a casting device for a metallic product according to a modification and specifically showing the state in which the metallic material in the pressurizing chamber is being pressurized by a pressurizing cylinder.

FIG. 6 shows a modification. This modification is basically of the same structure as that of the previous embodiment and achieves basically the same operation and result. The following explanation is centered about the portions of the present modification different from the previous embodiment. In this modification, shown in FIG. 6, a cooling passage 7*x*, being passed through by a coolant, such as cooling medium (water or cooling air), is formed as cooling means in the metallic back-up unit 7B. When the back-up unit 7B is arranged at the back-up position C1, the back-up unit 7B is contacted with the back surface 4*f* of the blade unit 4. Consequently, the blade unit 4, which tends to be heated to a higher temperature due to nipping in the heated metallic material M, can be cooled in an accelerated fashion to suppress thermal damage to the blade unit 4 as well as to improve its durability.

In the above-described embodiments, an aluminum alloy based material is used as the metallic material M. This, however, is merely illustrative, such that magnesium alloy based materials, zinc alloy based materials or other alloy based materials may also be used. Although the metallic material M is the solid/liquid co-existing type material, the metallic material may also be a liquid phase material. Although gate cavities 17 are provided in the above-described embodiments, in addition to the casting cavities 16, the gate cavities 17 may not be used, in which case the metallic material M is allowed to flow directly into the casting cavities 16. Although the metallic material M is adapted to flow into the casting cavities 16, upwards from below, in charging the metallic material M, this again is merely illustrative, such that the metallic material M may be adapted to flow into the casting cavities downwards from above or along a transverse direction. The back-up unit 7, which is metallic in the above-described embodiments, may also be formed of ceramics. The pressurizing chamber 14, which is cylindrically-shaped in the above-described embodiments, may also be square-tube-shaped. The present invention may also be executed with suitable changes within the scope of the invention without being limited to the above-described specified embodiments.

The meritorious effects of the present invention are summarized as follows.

It will be appreciated from the foregoing description that, with the casting device for metallic products according to the present invention, the first driving unit is actuated, on completion of the scraping operation for the outer layer of the metallic material, for shifting the blade unit from the scraping position to the non-scraping disengagement position. This enables the scraper edge of the blade unit and the metallic material M, so far in the nipping relation to each other, may readily be separated from each other. If once the scraper edge of the blade unit and the metallic material M are separated from each other in this manner, the metallic material in the pressurizing chamber of the main unit may readily be released from the pressurizing chamber.

If the backup unit is provided further, this backup unit is beforehand moved to the backup position, when the outer layer of the metallic material is scraped with the scraper edge of the blade unit, thus improving the retention performance of the blade unit. The result is that inadvertent shifting or displacement of the blade unit at the time of the scraping operation may be suppressed to assure highly accurate scraping operation for the outer layer of the metallic material. Moreover, if the second driving unit is provided for shifting the blade unit to the receded position, and there is no necessity for backup, the backup unit may be receded by the second driving unit from the back-up position to the receded position, so that the backup unit is not obstructive to the movement of the blade unit from the scraping position to the non-scraping disengagement position.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A casting device comprising a main unit including a pressurizing chamber for accommodating a metallic material in a solid/liquid co-existing state or in a liquid phase state and a casting cavity into which said metallic material is caused to flow to form a cast product;

a pressurizing unit for pressuring said metallic material contained in said pressurizing chamber of said main unit for forcing said metallic material into said casting cavity to produce a cast product; and a blade unit including a scraper edge provided between said pressurizing chamber and said casting cavity, said scraper edge being adapted for abutting against an outer layer of said metallic material, pressurized by said pressurizing unit, for scraping said outer layer;

said blade unit being set for being changed over between a scraping position at which said scraper edge of said blade unit is abutted against said metallic material to scrape the outer layer thereof and a disengagement position at which said scraper edge of said blade unit is disengaged from said metallic material, and there being provided a first driving unit for moving said blade unit from said scraping position to said disengagement position.

2. The casting device for a metallic product as defined in claim 1 further comprising a back-up unit arranged on a back side of said scraper edge of said blade unit for backing up said blade unit when said blade unit is at said scraping position.

3. The casting device for a metallic product as defined in claim 2 wherein said back-up unit is formulated so as to be changed over between a backup position in which the backup unit is arranged on the back surface of said scraper blade of said blade unit for backing up said blade unit and a receded position in which the backup unit is receded from said back surface.

4. The casting device for a metallic product as defined in claim 3 further comprising a second driving unit for moving said backup unit between said backup position and said receded position.

5. The casting device for a metallic product as defined in claim 1 wherein said main unit includes a chip accommodating chamber provided in communication with said pressurizing chamber below said blade unit for accommodating scraping chips produced on scraping said outer layer of the metallic material.

6. The casting device for a metallic product as defined in claim 1 wherein said blade unit is exchangeable with respect to said main unit.

7. The casting device for a metallic product as defined in claim 2 wherein said backup unit includes cooling means for cooling said blade unit through said backup unit.

8. The casting device for a metallic product as defined in claim 1 wherein said main unit includes a chip accommodating chamber provided in association with said pressurizing chamber in such a vicinity of said blade unit that immediately accommodates scraping chips produced on scraping said outer layer of the metallic material.

9. The casting device for a metallic product as defined in claim 1 wherein said blade unit is formulated in such a fashion that said changing over of said blade unit is performed by movement along a pressurizing direction of said pressurizing unit.

10. The casting device for a metallic product as defined in claim 9 wherein said pressurizing direction of said pressurizing unit is disposed along an axis of said scraper edge.

* * * * *